US008337327B2

(12) United States Patent
Dawson et al.

(10) Patent No.: US 8,337,327 B2
(45) Date of Patent: Dec. 25, 2012

(54) FAIRWAY WOOD TYPE GOLF CLUB HEAD

(75) Inventors: Patrick Dawson, San Diego, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 388 days.

(21) Appl. No.: 12/628,939

(22) Filed: Dec. 1, 2009

(65) Prior Publication Data

US 2010/0160075 A1 Jun. 24, 2010

Related U.S. Application Data

(60) Provisional application No. 61/122,480, filed on Dec. 15, 2008.

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS 5,067,715 A * 11/1991 Schmidt et al. ..... 473/332
5,163,682 A * 11/1992 Schmidt et al. ..... 473/332
5,310,186 A * 5/1994 Karsten ..... 473/345
5,474,296 A * 12/1995 Schmidt et al. ..... 473/346
5,755,624 A * 5/1998 Helmstetter ..... 473/291
5,851,160 A * 12/1998 Rugge et al. ..... 473/349
6,007,433 A * 12/1999 Helmstetter et al. ..... 473/328
6,244,976 B1 * 6/2001 Murphy et al. ..... 473/305
6,248,025 B1 * 6/2001 Murphy et al. ..... 473/324
6,299,547 B1 * 10/2001 Kosmatka ..... 473/329
6,305,063 B1 10/2001 Ashcraft
6,325,728 B1 * 12/2001 Helmstetter et al. ..... 473/328
6,332,847 B2 * 12/2001 Murphy et al. ..... 473/324
6,338,683 B1 * 1/2002 Kosmatka ..... 473/329
6,348,013 B1 * 2/2002 Kosmatka ..... 473/329
6,354,962 B1 * 3/2002 Galloway et al. ..... 473/342
6,364,788 B1 * 4/2002 Helmstetter et al. ..... 473/324
6,364,789 B1 * 4/2002 Kosmatka ..... 473/329
6,368,230 B1 * 4/2002 Helmstetter et al. ..... 473/244
6,368,234 B1 * 4/2002 Galloway ..... 473/349
6,390,932 B1 * 5/2002 Kosmatka et al. ..... 473/324
6,390,933 B1 * 5/2002 Galloway et al. ..... 473/345
6,398,666 B1 6/2002 Evans et al.
6,434,811 B1 * 8/2002 Helmstetter et al. ..... 29/407.08
6,471,603 B1 10/2002 Kosmatka et al.
6,607,452 B2 8/2003 Helmstetter et al.
6,648,772 B2 11/2003 Vincent et al.
6,776,723 B2 * 8/2004 Bliss et al. ..... 473/291
6,926,619 B2 8/2005 Helmstetter et al.
6,939,247 B1 * 9/2005 Schweigert et al. ..... 473/314
6,969,326 B2 * 11/2005 De Shiell et al. ..... 473/345
6,989,506 B2 1/2006 Yabu
7,051,416 B2 5/2006 Yabu
7,066,835 B2 * 6/2006 Evans et al. ..... 473/346
7,261,646 B2 * 8/2007 De Shiell et al. ..... 473/345
7,281,994 B2 * 10/2007 De Shiell et al. ..... 473/345
7,448,960 B2 11/2008 Gibbs et al.
7,563,175 B2 7/2009 Nishitani et al.

* cited by examiner

*Primary Examiner* — Alvin Hunter
(74) *Attorney, Agent, or Firm* — Michael A. Catania; Rebecca Hanovice; Sonia Lari

(57) ABSTRACT

A fairway wood type golf club head and method for forming is disclosed herein. The golf club head preferably has a cast body, a compression molded crown, and weight pads. The weight pads can be manipulated to create different mass property configurations for the golf club head using the same body and crown.

1 Claim, 7 Drawing Sheets

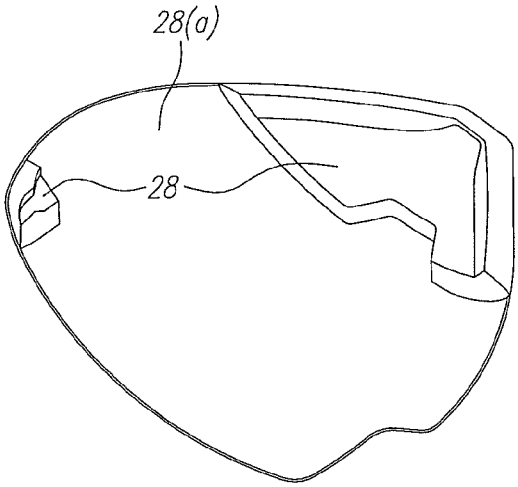
FIG. 5
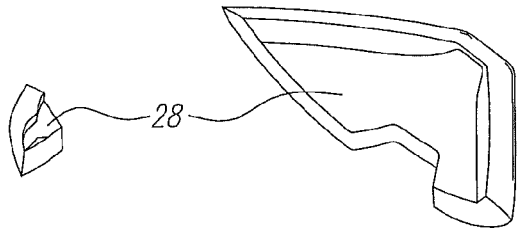
FIG. 5A
| Iteration | Bulge | Depth | Height | IYY | IZZ |
|---|---|---|---|---|---|
| 7 | 12 | 0.7295 | 0.0803 | 1013 | 2237 |
| 10 | 12 | 0.7769 | 0.0918 | 1155 | 2368 |
| 9 | 12 | 0.8182 | 0.1025 | 1266 | 2468 |
| 8 | 12 | 0.8951 | 0.1233 | 1448 | 2630 |
| 6 | 12 | 0.9675 | 0.1437 | 1595 | 2761 |
| 13 | 1.5 | 1.0482 | 0.1677 | 1731 | 2879 |
| 4 | 11.5 | 1.1184 | 0.1899 | 1826 | 2959 |
| 5 | 11 | 1.2295 | 0.2283 | 1927 | 3037 |
| 1 | 10.5 | 1.318 | 0.2599 | 1979 | 3075 |
| 2 | 10.5 | 1.375 | 0.2822 | 1991 | 3080 |
| 3 | 10.5 | 1.4109 | 0.2971 | 1991 | 3076 |
FIG. 6A

| | Backspin | | | Ballspeed | | | |
|---|---|---|---|---|---|---|---|
| Iteration | High | Center | Low | High | Center | Low | Ellipse Area |
| 7 | 2442 | 3400 | 4334 | 133.191 | 137.177 | 132.972 | 694.9335959 |
| 10 | 2553 | 3421 | 4267 | 133.755 | 137.192 | 133.451 | 649.450389 |
| 9 | 2625 | 3443 | 4239 | 134.111 | 137.169 | 133.7 | 601.1700159 |
| 8 | 2729 | 3489 | 4226 | 134.608 | 137.119 | 133.978 | 513.4834251 |
| 6 | 2805 | 3537 | 4246 | 134.98 | 137.094 | 134.132 | 436.6705846 |
| 13 | 2877 | 3599 | 4295 | 135.302 | 137.046 | 134.182 | 355.7041992 |
| 4 | 2935 | 3661 | 4359 | 135.515 | 136.973 | 134.131 | 449.3120406 |
| 5 | 3027 | 3783 | 4505 | 135.709 | 136.737 | 133.812 | 505.5431329 |
| 1 | 3104 | 3897 | 4649 | 135.924 | 136.636 | 133.595 | 605.6309598 |
| 2 | 3160 | 3986 | 4765 | 136.002 | 136.493 | 133.332 | 530.8326232 |
| 3 | 3200 | 4049 | 4849 | 136.05 | 136.396 | 133.139 | 490.5657639 |

*FIG. 6B*

| | Robustness | | | Carry Distance | | Total Distance | |
|---|---|---|---|---|---|---|---|
| Iteration | Ballspeed | Backspin | Sidespin | Average | Std Dev | Average | Std Dev |
| 7 | 13.68699 | 2560.903 | 646.3042 | 197.6682 | 12.00478 | 219.6416 | 12.53413 |
| 10 | 12.85247 | 2248.162 | 647.4413 | 199.0399 | 11.34248 | 220.5421 | 11.75994 |
| 9 | 12.24959 | 2072.818 | 659.9483 | 199.8237 | 10.93425 | 221.0082 | 11.28195 |
| 8 | 11.34122 | 1869.579 | 692.5193 | 200.7975 | 10.42921 | 221.5023 | 10.69527 |
| 6 | 10.6614 | 1772.891 | 733.4137 | 201.3989 | 10.16902 | 221.7165 | 10.39037 |
| 13 | 10.03505 | 1735.351 | 793.8129 | 201.8132 | 10.01173 | 221.6327 | 10.22665 |
| 4 | 9.603626 | 1748.675 | 851.2326 | 201.8076 | 10.01907 | 221.4231 | 10.15114 |
| 5 | 9.042677 | 1849.425 | 961.5768 | 201.2798 | 10.20477 | 220.4459 | 10.18527 |
| 1 | 8.668406 | 1971.718 | 1056.659 | 200.8415 | 10.45607 | 219.6605 | 10.2612 |
| 2 | 8.479753 | 2081.63 | 1126.42 | 200.1289 | 10.74928 | 216.7424 | 10.38573 |
| 3 | 8.377198 | 2162.463 | 1173.9 | 199.5871 | 10.99175 | 218.0729 | 10.50413 |

*FIG. 6C*

FAIRWAY WOOD TYPE GOLF CLUB HEAD

CROSS REFERENCES TO RELATED APPLICATIONS

The present application claims priority to U.S. Provisional Patent Application No. 61/122,480, filed on Dec. 15, 2008.

STATEMENT REGARDING FEDERALLY SPONSORED RESEARCH OR DEVELOPMENT

Not Applicable

BACKGROUND OF THE INVENTION

1. Field of the Invention

The present invention relates to a fairway wood type golf club head.

2. Description of the Related Art

The prior art discloses fairway wood type golf club heads. One method for manufacturing a fairway wood type golf club head is disclosed in U.S. Pat. No. 7,563,175, issued to Nishitani, et al. The method involves manufacturing the face member of the head by laser welding together a central metal piece, and intermediate metal piece, and an outer metal piece.

Another method for manufacturing of a golf club head is disclosed in U.S. Pat. No. 6,648,772, issued to Vincent et al. for Golf Club Head and Method for Making It. This patent discloses controlling the desired weight of the golf club head by installing a cavity in the rear wall of a golf club head's hollow main body which is capable of encompassing a range of weights.

Yet another method for manufacturing a golf club head is disclosed in U.S. Pat. No. 7,051,416, issued to Yabu for Golf Club Head and Method of Making the Same. The method comprises making a wax model of the hollow main body having an opening, wherein in order to prevent deformation of the wax model during making a casting mold, the wax model is provided with a brace.

U.S. Pat. No. 6,989,506 for Method of Making Golf Club Head, discloses a method which comprises making two metal parts, wherein at least one of them is provided with a small protrusion along the surface to be welded. This metal part is laser welded to the opposite surfaces by applying a laser beam to at least the protrusion so that the molten material of the protrusion penetrates into a gap between the opposite surfaces to connect the two metal parts.

U.S. Pat. No. 6,305,063 for Method of Manufacturing a Golf Club Head, discloses a method of making a golf club head having a center of gravity which comprises providing a solid billet of material and milling out a cavity in the billet. The cavity has dimensions selected to control the center of gravity.

When prototyping clubs, it is necessary to predetermine the CG position and total weight before a casting tool is made. The CG position and total weight is determined by club shape and core design of the casting tool. The core of the casting tool is what creates the hollow portion inside the club. The core piece is part of the casting tool and can be expensive to replace, if there is a desire to change the CG position and/or the total mass of the club.

BRIEF SUMMARY OF THE INVENTION

One preferred embodiment of the present invention describes the use of a single core tool that is used to create the body of a fairway wood that has no internal weight. The walls of the body are a consistent thickness, preferably the thinnest possible for casting a particular alloy of steel or titanium. In addition to the cast body of constant wall thickness, additional cast pieces, which represent the shape of the internal features of the club, are made of the same density or higher density alloy. The additional cast pieces are cut in different combinations and bonded to the inside of the constant thickness body. The present invention provides a method to produce a single outside shape with a variety of CG positions and/or total weight.

The process preferably requires three tools: a body casting tool with a simple core; a composite crown tool, for stamping a constant thickness crown; and a sole weight pad tool. Optionally, a high front weight pad tool is also utilized in practicing the present invention.

The body casting tool preferably has a crown opening. The body preferably contains a hosel and a faceplate. The body preferably has a constant thickness, except for areas around the hosel and the face. The face preferably has a variable face thickness pattern or alternatively a similar non constant thickness. The crown can be made out of composite, for bonding using glue, or constant thickness sheet metal, for welding or brazing. The sole weight pad is a part which preferably covers the entire internal sole of the club. The sole weight pad may also be trimmed to various configurations to bring the sole weight pad to the appropriate weight. The variation in trimming of the weight pads produces different club weights and/or CG positions. The high front weight pad is manufactured and processed similar to the sole weight pad. The weight pads are bonded into the open body using weld or glue. After an appropriate cure time, the crown is bonded, brazed, or welded together.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 5 is an isolated view of a sole weight pad base component and trimmed sole weight components for an all rear configuration embodiment of a golf club head of the present invention.

FIG. 5*a* is an isolated view of a trimmed sole weight component for an all rear configuration embodiment of a golf club head of the present invention.

FIG. 6A is a Table of mass properties of different embodiments of the golf club head of the present invention.

FIG. 6B is a Table of robustness, carry distance and total distance of the golf club head of the present invention.

FIG. 6C is a Table of robustness of different embodiments of the golf club head of the present invention.

DETAILED DESCRIPTION OF THE INVENTION

Figure 1:
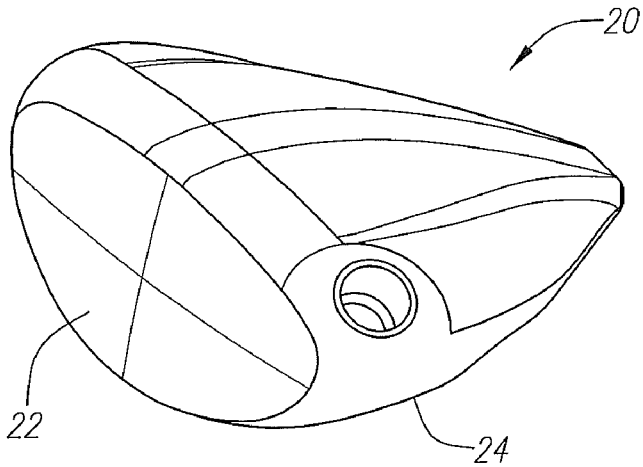
FIG. 1 is a top perspective view of a preferred embodiment of a golf club head of the present invention.

As shown in FIGS. 1-5, a fairway wood type golf club head 20 has several components including a body 21 having a striking plate section 22 and a sole section 24, a crown section 26, a sole weight pad 28 and a high weight pad 30. The body 21 is preferably cast from a stainless steel material. The crown 26 is preferably composed of a composite material.

The crown section 26 is generally convex toward the sole section 24, and transitions into the ribbon section. The crown section 26 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

The fairway wood type golf club head 20 comprises a body 21 composed of a first material, which includes a striking plate section 22, a sole section 24, and an open top 40. A sole weight pad 28 composed of a second material preferably covers substantially all of an internal surface of the sole section 24 of the body. A high weight pad 30 composed of a third material is also attached to the body 21. Additionally, there is a crown section 26 composed of a fourth material. The crown section 26 covers the open top 40 of the body 21.

The body 21 is preferably composed of a stainless steel material or a titanium alloy material. The crown section 26 is preferably composed of a light-weight metal material selected from the group consisting of aluminum alloy, magnesium alloy and tin. The sole weight pad 28 is preferably composed of a tungsten alloy material.

Figure 3:
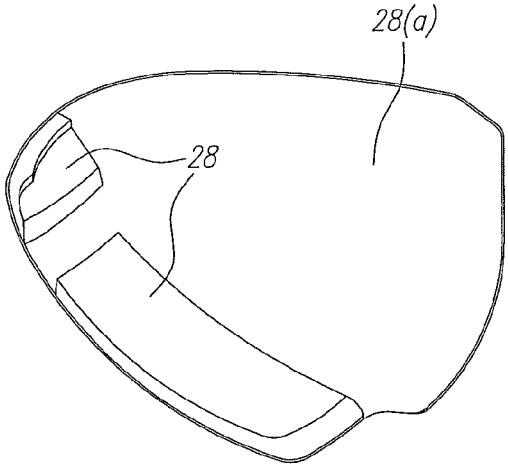
FIG. 3 is an isolated view of a sole weight pad base component and trimmed sole weight component for an all forward configuration embodiment of a golf club head of the present invention.
Figure 4:
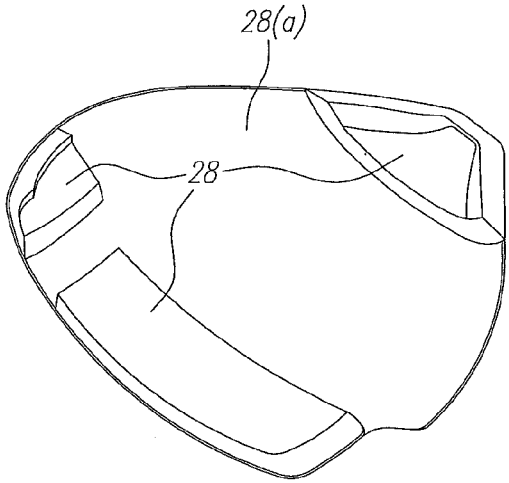
FIG. 4 is an isolated view of a sole weight pad base component and trimmed sole weight components for a balanced configuration embodiment of a golf club head of the present invention.

The golf club head 20 has a configuration selected from the group of an all balanced configuration as shown in FIG. 4, a forward configuration as shown in FIG. 3, and a rear configuration as shown in FIG. 5. The total mass, head frame mass, and impact mass properties are detailed below based on each configuration in Tables 1-3.

TABLE 1

| Forward Configuration of Golf Club Head. | |
|---|---|
| Total Mass | 209.617 |
| Head Frame Mass Properties | |
| CGX | 0.1374 |
| CGY | 0.8395 |
| CGZ | 0.5944 |
| IXX | 1794.62 |
| IYY | 995.02 |
| IZZ | 2315.48 |
| IXY | 51.14 |
| IXZ | −42.09 |
| IYZ | −1.61 |
| Impact Frame Mass Properties | |
| CGX | 0.7325 |
| CGY | −0.0576 |
| CGZ | 0.0557 |

TABLE 2

| Balanced Configuration of Golf Club Head. | |
|---|---|
| Total Mass | 209.95 |
| Head Frame Mass Properties | |
| CGX | 0.4513 |
| CGY | 0.8552 |
| CGZ | 0.6057 |
| IXX | 1731.41 |
| IYY | 1687.53 |
| IZZ | 2965.49 |
| IXY | 97.62 |
| IXZ | −173.68 |
| IYZ | −6.57 |
| Impact Frame Mass Properties | |
| CGX | 1.0334 |
| CGY | −0.042 |
| CGZ | 0.1458 |

TABLE 3

| Rearward Configuration of Golf Club Head. | |
|---|---|
| Total Mass | 209.225 |
| Head Frame Mass Properties | |
| CGX | 0.7568 |
| CGY | 0.8117 |
| CGZ | 0.6083 |
| IXX | 1622.12 |
| IYY | 1785.28 |
| IZZ | 2968.63 |
| IXY | 184.91 |
| IXZ | −285.65 |
| IYZ | −18.91 |
| Impact Frame Mass Properties | |
| CGX | 1.3284 |
| CGY | −0.0855 |
| CGZ | 0.2253 |

A method for an embodiment of the present invention involves casting a body 21. The body 21 preferably has constant thickness except in the face region. The body 21 is preferably cast using a tool that is pulled from a crown region 26. The method also includes casting a sole weight pad 28 and a high front weight pad 30. The pads are trimmed into preferable masses and shapes to create a golf club head 20 with a particular mass property configuration. Such configurations can be seen in FIGS. 3*a*, 4*a*, and 5*a*.

Figure 2:
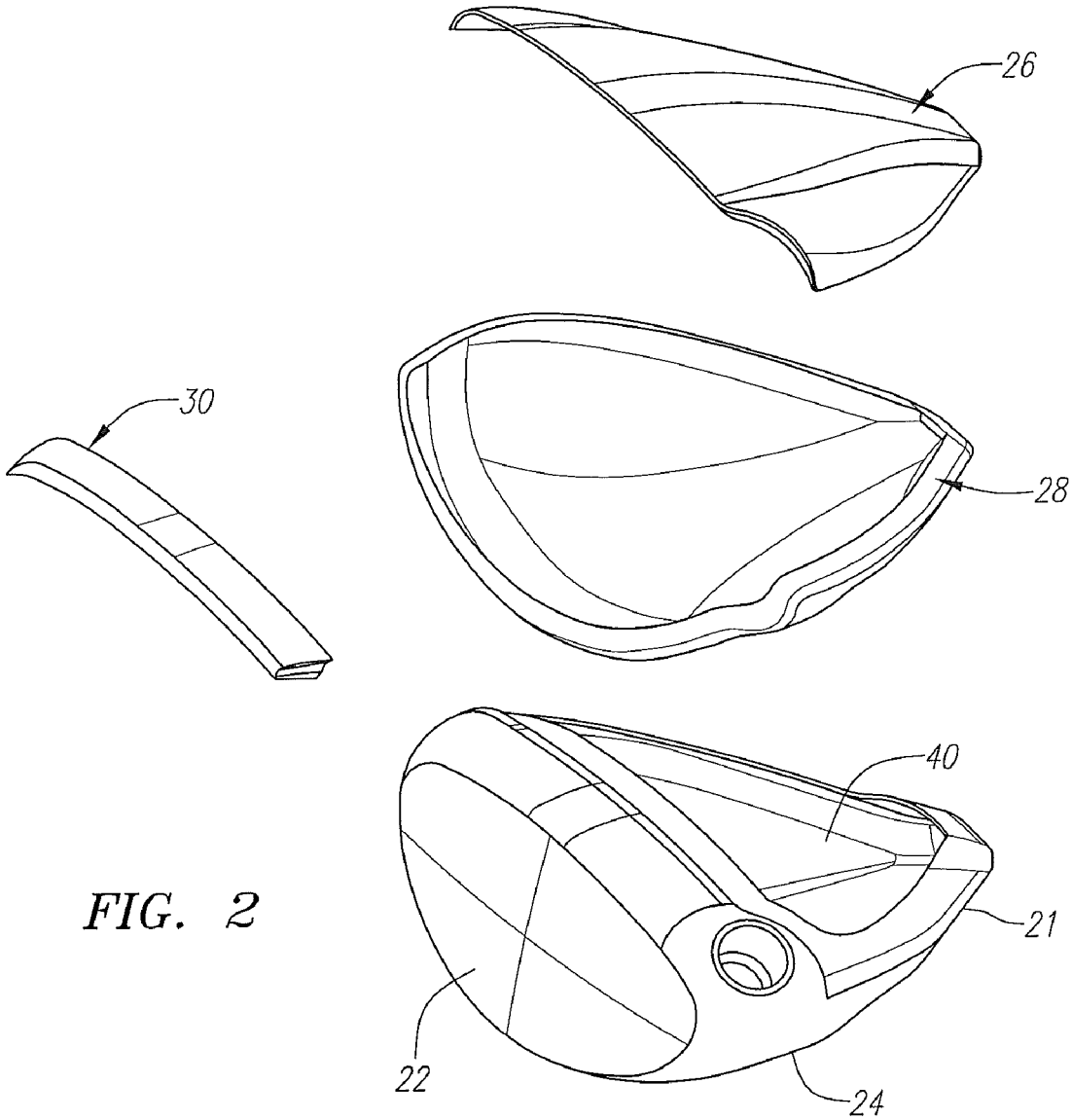
FIG. 2 is a top perspective exploded view of a preferred embodiment of a golf club head of the present invention.
Figure 3A:
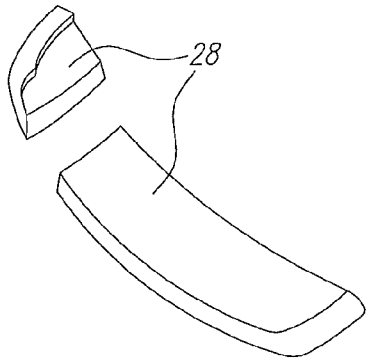
FIG. 3*a* is an isolated view of a trimmed sole weight component for an all forward configuration embodiment of a golf club head of the present invention.
Figure 4A:
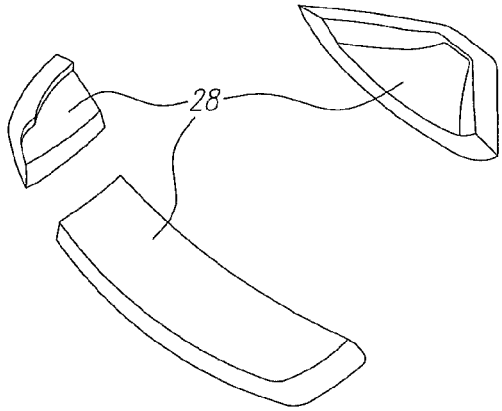
FIG. 4*a* is an isolated view of a trimmed sole weight component for a balanced configuration embodiment of a golf club head of the present invention.

Other embodiments of the present invention include sole weight pads 28 which are trimmed to various configurations, such as those in FIGS. 3*a*, 4*a*, and 5*a*, while still maintaining a sole weight pad base component 28*a*, preferably of minimum thickness. Such configurations can be seen in FIGS. 3, 4, and 5. Yet another embodiment of the sole weight pad is one of constant thickness as seen in FIG. 2.

Such mass property configurations are discussed in U.S. Pat. No. 6,926,619 for a Golf Club Head With Customizable Center Of Gravity, which pertinent parts concerning mass properties and golf club head configurations of center of gravity are hereby incorporated by reference. Next in the method, the crown 26 is formed, preferably using a compression molded composite material. Next, the weight pads are attached to the interior of the body using adhesives or possibly welding. Next, the crown 26 is bonded to the body 21 using adhesives. The golf club head 20 is finished by polishing and/or painting.

The golf club head 20 preferably has a volume from 150 cubic centimeters to 420 cubic centimeters, more preferably from 200 cubic centimeters to 370 cubic centimeters. The volume of the golf club head 20 varies between fairway woods (preferably ranging from 3-woods to eleven woods).

The golf club head 20 preferably has a mass of 135 grams to 300 grams, and preferably from 140 grams to 185 grams.

The high weight pads 30 preferably have a mass ranging from 5 grams to 50 grams, more preferably from 10 grams to 30 grams, and most preferably from 15 grams to 25 grams. The high weight pads 30 are preferably composed of a material that has a density ranging from 5 grams per cubic centimeters to 20 grams per cubic centimeters, more preferably from 7 grams per cubic centimeters to 12 grams per cubic centimeters.

The high weight pads 30 are preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred high weight pad 30 is an injection molded thermoplastic polyurethane integrated with tungsten to have a density of 8.0 grams per cubic centimeters. In an alternative embodiment, the high weight pad 30 is composed of from 50 to 95 volume percent polyurethane and from 50 to 5 volume percent tungsten. Also, in an alternative embodiment, the high weight pad 30 is composed of from 10 to 25 weight percent polyurethane and from 90 to 75 weight percent tungsten. The placement of the high weight pads 30 allow for the moment of inertia of the golf club head to be optimized.

Figure 7:
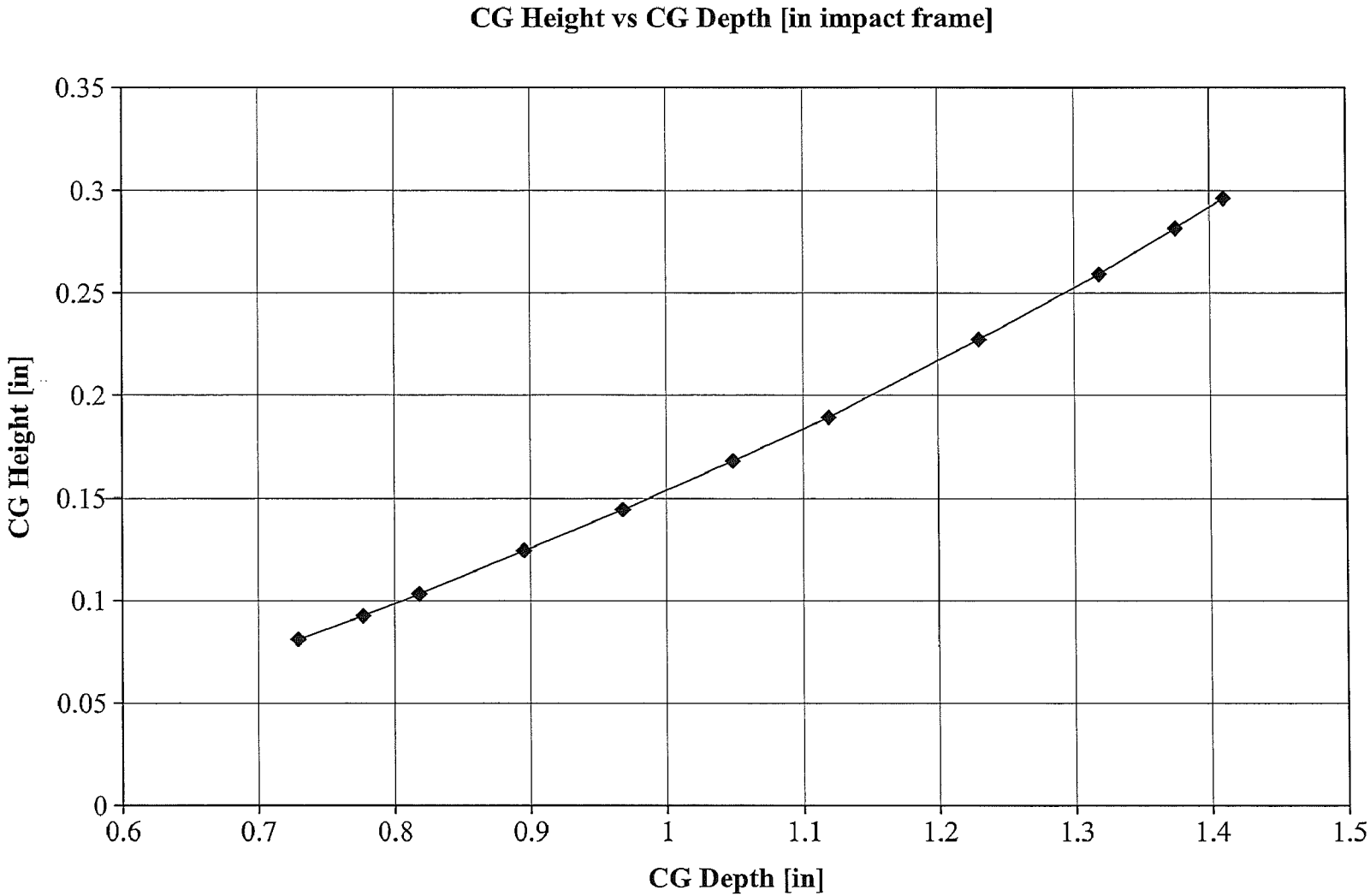
FIG. 7 is a graph of center of gravity ("CG") Height vs. CG depth.
Figure 8:
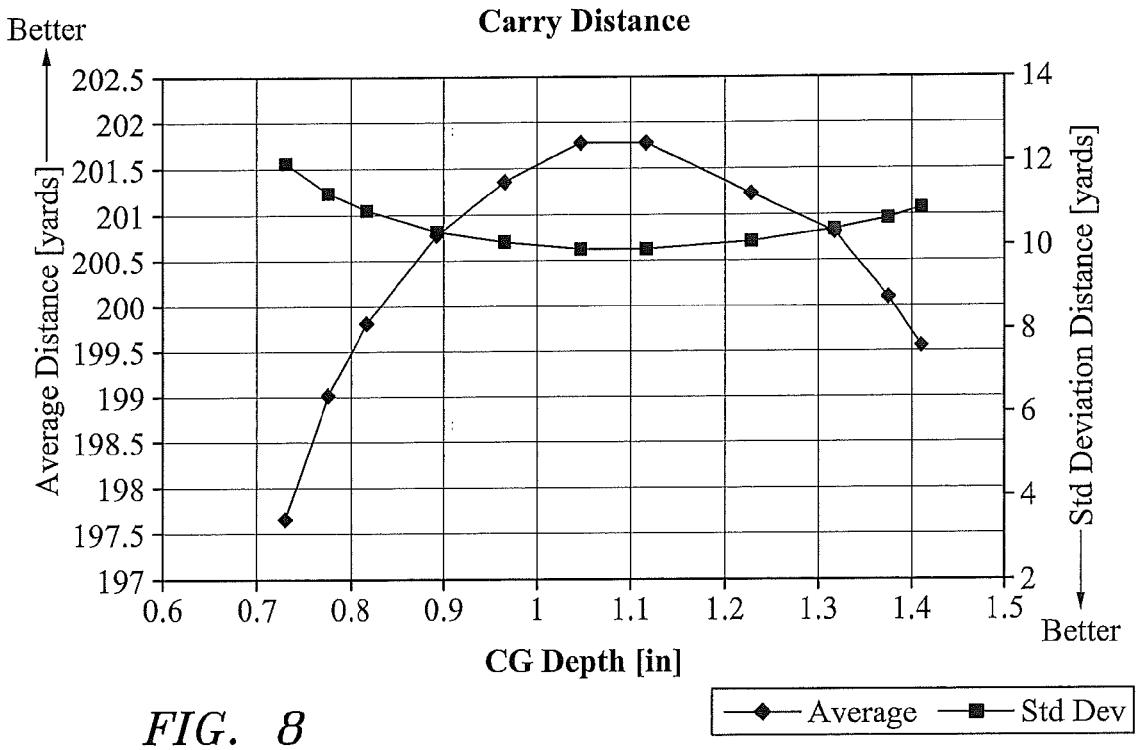
FIG. 8 is a graph of carry distance vs. CG depth.
Figure 9:
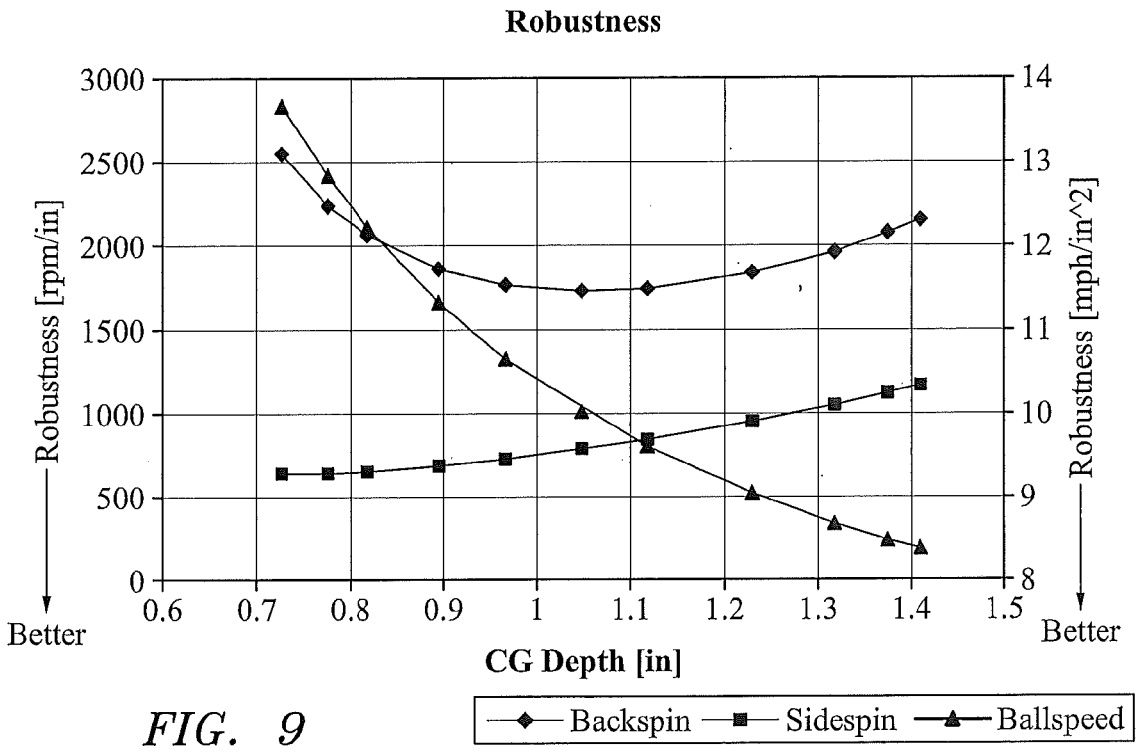
FIG. 9 is a graph of robustness vs. CG depth.
Figure 10:
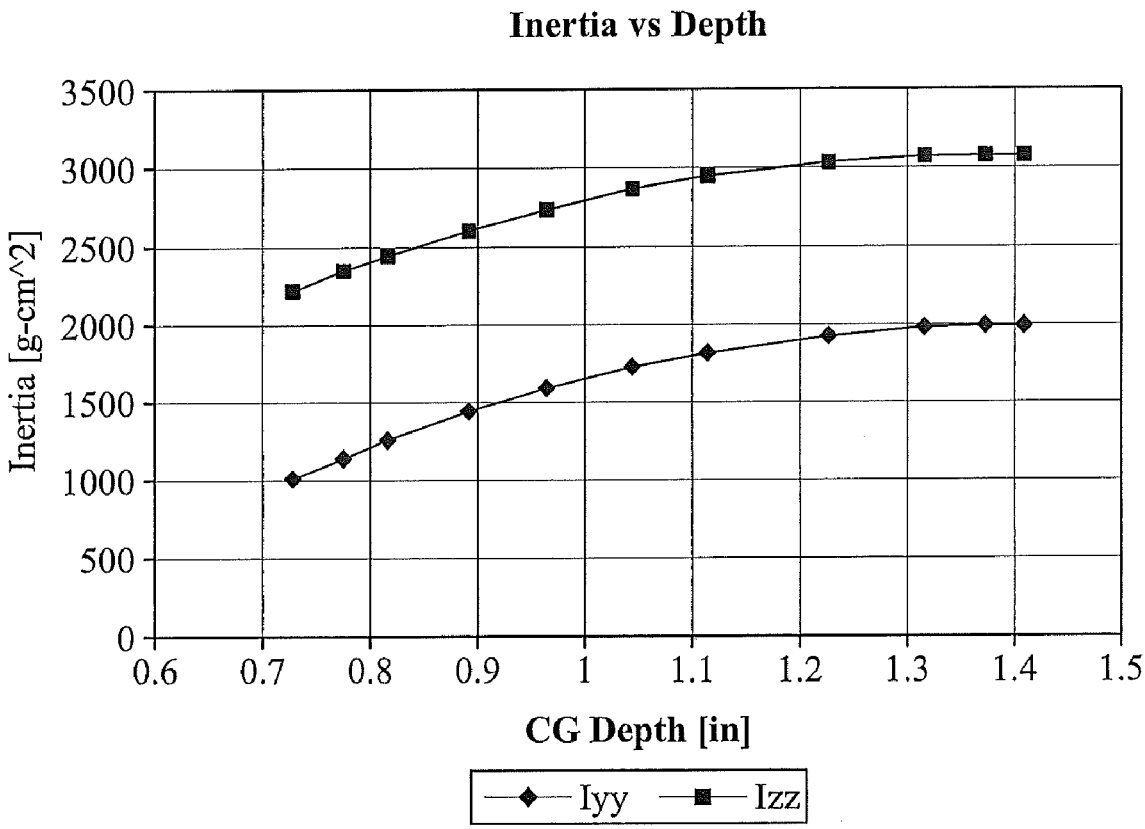
FIG. 10 is a graph of inertia vs. CG depth.

As shown in FIG. 6A-6C the mass properties, robustness, carry distance and total distance of different embodiments of the golf club head of the present invention vary according to iteration. FIG. 7 is a graph of center of gravity ("CG") Height vs. CG depth. FIG. 8 is a graph of carry distance vs. CG depth. FIG. 9 is a graph of robustness vs. CG depth. FIG. 10 is a graph of inertia vs. CG depth.

The striking plate 22 has a varying thickness. In a preferred embodiment, the striking plate 22 has a varying thickness such as described in U.S. Pat. No. 7,448,960, for a Golf Club Head With Variable Face Thickness, which pertinent parts are hereby incorporated by reference. Other alternative embodiments of the thickness of the striking plate 72 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking plate has a uniform thickness.

The body 21 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 43 is composed of 17-4 steel alloy. Additional methods for manufacturing the body 21 include forming the body 21 from a flat sheet of metal, super-plastic forming the body from a flat sheet of metal, machining the body 21 from a solid block of metal, electrochemical milling the body 21 from a forged pre-form, casting the body using centrifugal casting, casting the body 21 using levitation casting, and like manufacturing methods.

The center of gravity and the moment of inertia of a golf club head are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head 20. Given the weight of the golf club head 20, the scales allow one to determine the weight distribution of the golf club head 20 when the golf club head 20 is placed on both scales simultaneously and weighed along a particular direction, the X, Y or Z direction. Those skilled in the pertinent art will recognize other methods to determine the center of gravity and moments of inertia of a golf club head 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a body composed of stainless steel, the body having a striking plate section, a sole section, and an open top;

a sole weight pad composed of a tungsten alloy material, the sole weight pad comforting to substantially all of an internal surface of the sole section of the body;

a high weight pad composed of a polymer material integrated with a metal, the high weight pad having a density of 7 to 12 grams/cubic centimeter, the high weight pad having a mass ranging from 15 to 25 grams, the high weight pad attached to the body; and a crown composed of a composite material and having a thickness ranging from 0.028 to 0.040 inch, the crown covering the open top of the body;

wherein the golf club head has a volume ranging from 200 to 370 cubic centimeters, and mass ranging from 135 to 300 grams.

* * * * *